US006145437A

United States Patent [19]

Böck et al.

[11] Patent Number: 6,145,437

[45] Date of Patent: Nov. 14, 2000

[54] ANILOX INKING UNIT FOR A ROTARY OFFSET PRINTING MACHINE

[75] Inventors: Thomas Böck, Neusäss; Ernst Marny, Friedberg-Haberskirch; Norbert Dylla, Stadtbergen, all of Germany

[73] Assignee: MAN Roland Druckmaschinen AG, Offenbach am Main, Germany

[21] Appl. No.: 09/274,630

[22] Filed: Mar. 23, 1999

[30] Foreign Application Priority Data

Mar. 23, 1998 [DE] Germany ..... 298 05 201 U

[51] Int. Cl.[7] ..... B41F 31/00

[52] U.S. Cl. ..... 101/349.1; 101/351.1

[58] Field of Search ..... 101/349.1, 350.6, 101/351.1, 351.8, 348, 352, 366, 340

[56] References Cited

U.S. PATENT DOCUMENTS

| | | | |
|---|---|---|---|
| 4,452,139 | 6/1984 | Dahlgreen et al. | 101/148 |
| 5,140,901 | 8/1992 | John | 101/366 |
| 5,209,160 | 5/1993 | Smith | 101/148 |
| 6,006,665 | 12/1999 | Stucklik et al. | 101/352.13 |

FOREIGN PATENT DOCUMENTS

| | | | |
|---|---|---|---|
| 1 107 247 | 4/1961 | Germany | B41F 34/04 |
| 25 33 004 | 6/1988 | Germany | B41F 31/06 |
| 0 116 893 | 10/1989 | Germany | B41F 31/28 |
| 57-140167 | 8/1982 | Japan | B41F 31/06 |

*Primary Examiner*—John S. Hilten
*Assistant Examiner*—Darius N. Cone
*Attorney, Agent, or Firm*—Cohen, Pontani, Lieberman & Pavane

[57] ABSTRACT

An anilox inking unit for an offset printing machine having an anilox roll having a rotation direction and a fluid blowing device arranged along the anilox roll . The blowing device is disposed downstream of a working doctor with respect to the rotation direction of the anilox roll and upstream of the ink transfer point. In accordance with one embodiment, the fluid being blown by the blowing device is ambient air.

11 Claims, 4 Drawing Sheets

ANILOX INKING UNIT FOR A ROTARY OFFSET PRINTING MACHINE

BACKGROUND OF THE INVENTION

1. Field of the Invention

The invention relates to printing machines, and more particularly to an anilox inking unit for a rotary offset printing machine.

2. Description of the Related Art

In offset printing machines, the interplay between ink and damping solution is a delicate matter. On the one hand, a certain proportion of water in the ink is desired and is also necessary for printing such that excess ink rapidly runs off the printing plate, but on the other hand too much water may result in problems and even in failure of the ink transfer. Depending on the degree of emulsification of offset printing ink, there are offset-stable emulsions with a water content of up to 40%, where the water present is very finely distributed in the printing ink, and offset-unstable emulsions with a water content of greater than 40% where the water is present in relatively large drops or as free water.

In the case of conventional inking units, an excessively high water content in the ink (free water) is not such a problem, since the roll surface, which is large overall, provides the free water with the possibility of evaporating. The water is also emulsified into the ink in the splitting points, of which there are a large number. Free water also impairs the splitting behavior of the ink. The effects in the printing process are an increase in the ink density and the clogging of screen areas. In the case of the conventional, long inking unit, the printer has the possibility of exerting an influence on the printing result by adjusting the zone screws.

Short inking units, which include the anilox inking unit, have a low number of ink transport rolls from the source of the ink to the printing plate. The relatively small roll surface provides little opportunity for excess water to evaporate. In addition, short inking units do not have the ability to influence the inking by means of zone screws, that is, it is not possible to counteract the failure of the ink transfer. The state of the art currently adds fresh ink or additives to the ink in the short inking unit. A high degree of care in the water supply is demanded of the printing machine operator. He is always working between the scumming limit (i.e., he will print rejects in the event of the smallest downward deviation of the water values) and disturbing the transfer of ink as a result of overdamping. The low supply of water also results in an increased outlay on cleaning and personnel resulting from the increased build-up of paper dust on the rubber blanket. This in turn leads to stoppages and renewed start-up rejects.

According to EP 0 224 033 B1, dry air is blown onto the surface of the screen roll in an anilox short inking unit before the roll passes a chamber-type doctor or a feed roll for filling with fresh ink. Although excess water is evaporated before the source of the printing ink is reached, water which is pressed into the dimples downstream of the nip between the ink applicator roll and the screen roll cannot be removed. In the chamber-type doctor, the dimples are flushed and water gets into the ink.

SUMMARY OF THE INVENTION

It is an object of the invention to provide an inking unit which provides favorable ink splitting preconditions when the ink is being transported from the anilox roll to the plate cylinder.

This and other objects are achieved in an inking unit according to the invention where as the anilox roll passes under the working doctor, water lying on the filled anilox roll as a very thin film or in the form of small droplets can be separated as a result of the prevailing pressure conditions and high shear forces. This water then disturbs the ink splitting between the anilox and applicator rolls. By means of the fluid which is blown on by a blowing device, this surface water is evaporated, which provides the precondition for a subsequent proper splitting of the ink. As a result, with the increased damping solution freedom, the printing process is stabilized without zone screws having to be adjusted or the addition of fresh ink and other additives. By this means, high printing quality with good consistency during continuous printing is achieved. At the same time, the operation of the printing machine is made easier, and printing parameters are more reproducible. By virtue of the increased damping solution freedom, the build-up of paper dust on the rubber blanket can be reduced. Overall, a reduction in printing rejects is made possible.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings wherein like reference numerals denote similar elements throughout the views.

DETAILED DESCRIPTION OF PREFERRED EMBODIMENTS

Figure 1:
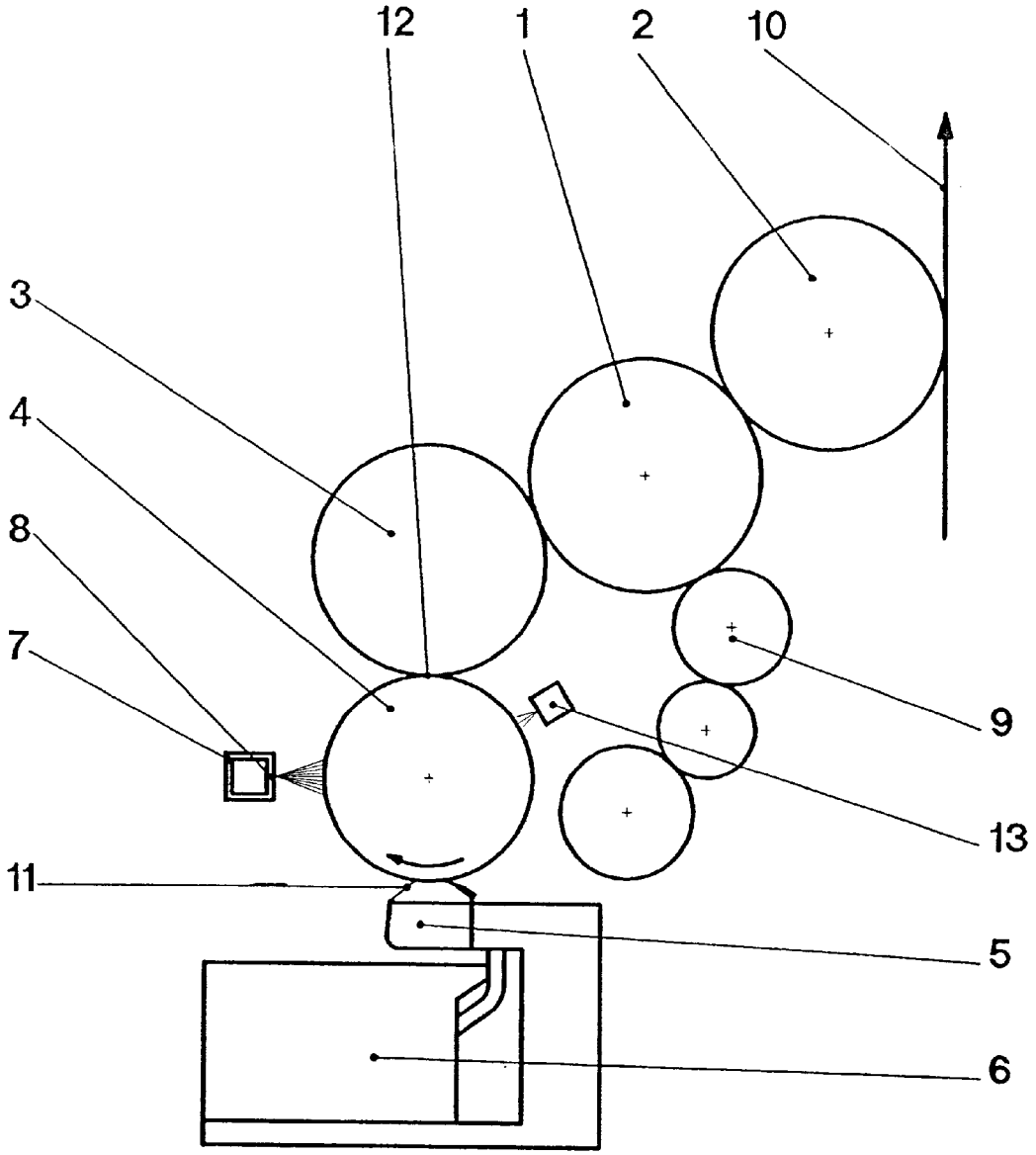
FIG. 1 is a side view of an anilox inking unit.

FIG. 1 shows a side view of an anilox inking unit which is arranged on a printing unit. The plate cylinder 1 and the transfer cylinder 2 of the printing unit are illustrated. An applicator roll 3 is in contact with the plate cylinder 1 and is also in contact with an anilox roll 4. It is also possible for a number of applicator rolls to be arranged between the plate cylinder 1 and anilox roll 4. Furthermore, an indirect connection between the applicator roll 3 and the anilox roll 4 via an intermediate roll is possible. The term screen roll is also commonly used for the anilox roll 4, since dimples which can be filled with ink are arranged on its surface in the manner of a screen grid. A chamber-type doctor 5 is brought into contact with the anilox roll 4 and is connected to an ink trough 6. A nozzle bar 7 with nozzles 8 arranged alongside of one another in the longitudinal direction of the anilox roll 4 is installed along the anilox roll 4, downstream of the chamber-type doctor 5 in the direction of rotation. The nozzles 8 are designed as holes in the wall of the hollow nozzle bar 7. And may also be designed as slots. A damping unit 9 is arranged on the plate cylinder 1.

The printing unit prints a web 10 by means of the transfer cylinder 2, which interacts with an impression cylinder (not illustrated), for example with the transfer cylinder of a further printing unit. The transfer cylinder 2 receives the printing image to be applied to the web 10 from the printing plate of the plate cylinder 1. Plate cylinder 1 is dampened by means of the damping unit 9 and inked by means of the applicator roll 3. Printing ink is fed to the applicator roll 3 by means of the anilox roll 4, whose screen dimples are flushed and filled by the chamber-type doctor 5. The printing ink is pumped to the chamber-type doctor 5 from the ink trough 6 by means of an ink pump (not illustrated). As viewed in the direction of rotation of the anilox roll 4, the chamber-type doctor 5 terminates with a working doctor 11, which wipes excess ink cleanly off the filled anilox roll 4. Subsequently, the surface of the anilox roll 4, including the surface of its ink filling, has a fluid applied to it by means of the nozzle bar 7, any surface water which is present is removed by evaporation. In this and the following exemplary embodiments, the fluid is room or ambient air, with it also being possible to use specifically dried air or other fluids. The transfer of ink to the applicator roll 3 subsequently takes place at the point of contact 12 between the anilox roll 4 and the applicator roll 3. Optionally arranged upstream of the chamber-type doctor 5, in the direction of rotation of the anilox roll 4, is a further blowing device 13, with which residual ink on the anilox roll 4 can be dried on the surface before it runs into the chamber-type doctor 5. It is also unnecessary for the working doctor to be integrated in a closed ink feed system, as a subsequent exemplary embodiment will show.

Figure 2:
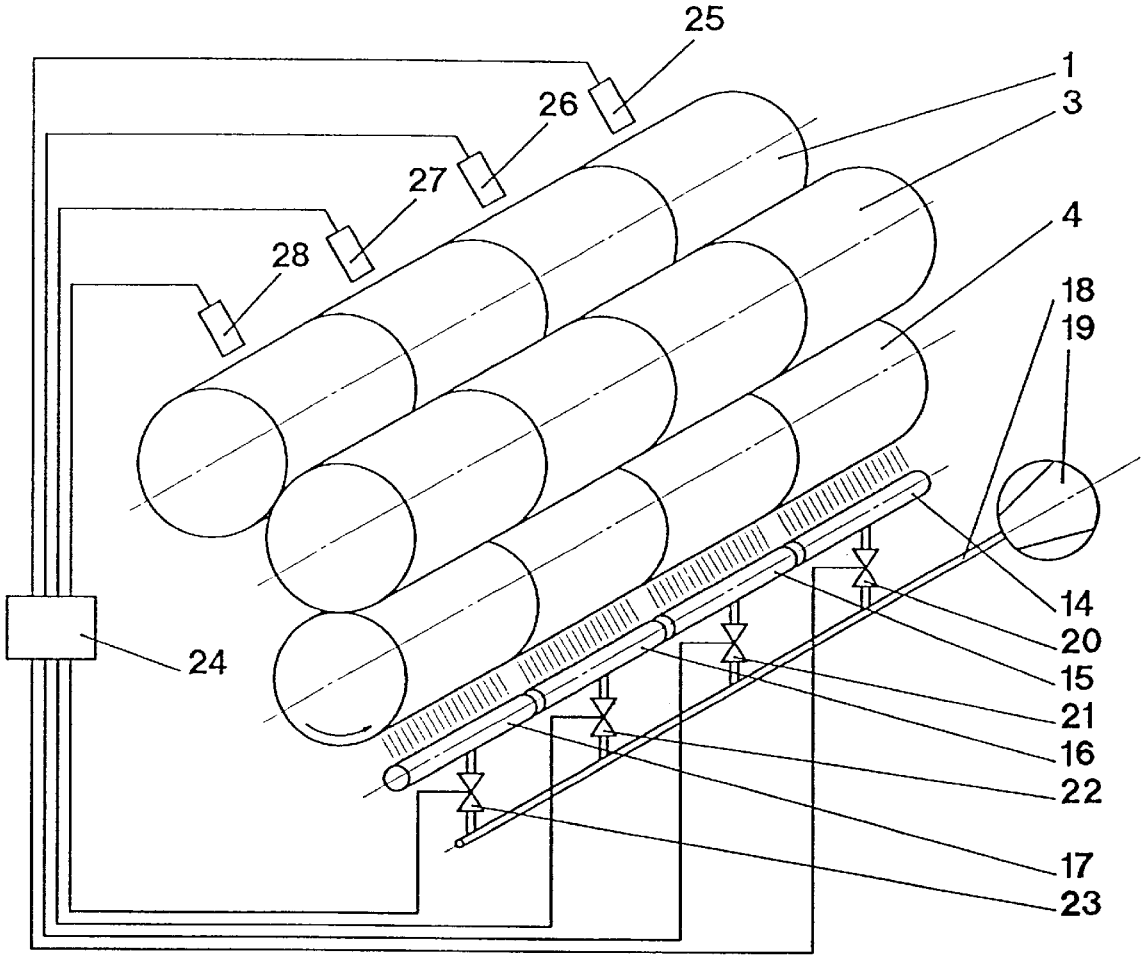
FIG. 2 is a partial perspective view of a first modified embodiment of the anilox printing unit of FIG. 1.

For reasons of simplicity in the following exemplary embodiments, the previous item numbers will largely be maintained in the case of repeating components. FIG. 2 shows only part of an anilox inking unit for a rotary offset printing machine. The plate cylinder 1, the applicator roll 3 and the anilox roll 4 are shown. The plate cylinder 1 or the printing unit is four pages wide. Four pipes 14 to 17 are arranged on the anilox roll 4, downstream, in its direction of rotation, of the working doctor blade (not illustrated), each pipe covering the area of one page. Each pipe 14 to 17 has a slot nozzle which extends over its length and is directed towards the anilox roll 4, or a number of shorter slot nozzles. Furthermore, each pipe 14 to 17 is supplied via a line 18 with compressed air produced by a blower 19. A valve or throttling member 20 to 23 is provided in each of the feed lines to the respective pipes 14 to 17. The adjusting members of the valves 20 to 23 are each connected to an output of a control device 24. The inputs of control device 24 are in each case connected a sensor 25 to 28 which is respectively assigned to the area of one page of the plate cylinder 1 and senses the inking, for example the ink layer thickness. The sensors 25 to 28 may also be arranged on the transfer cylinder 2. On the anilox roll 4, there is also an inking device (not illustrated), for example a chamber-type doctor.

The quantity of air applied by the blowing device shown in FIG. 2 can be adjusted over the width of a page in accordance with the inking that has been carried out. For example, if the sensor 25 registers scumming the quantity of air flowing out of the slot nozzle of the pipe 14 is reduced by adjusting the valve 20 in the closing direction. Thus the surface of the associated page area of the anilox roll 4 is dried less and, as a result less ink is transferred to the applicator roll 3. Conversely, in the event of a lack of ink being determined by the sensor 25, a greater quantity of air is applied to the page area of the anilox roll 4 by opening the valve 23 further, causing the surface to be dried further and the transfer of ink to the applicator roll 3 to be improved. Sensors 26 to 28 are controlled in the same manner via the control device 24, using valves 21 to 23 of pipes 15 to 17, respectively. In the absence of sensors 25 to 28 and of the control device 24, the desired amount of air can also be usually set by hand at the valves 20 to 23. The quantity of air applied can also be changed, for example, by varying the pressure of the air output by the blower 19.

Figure 3:
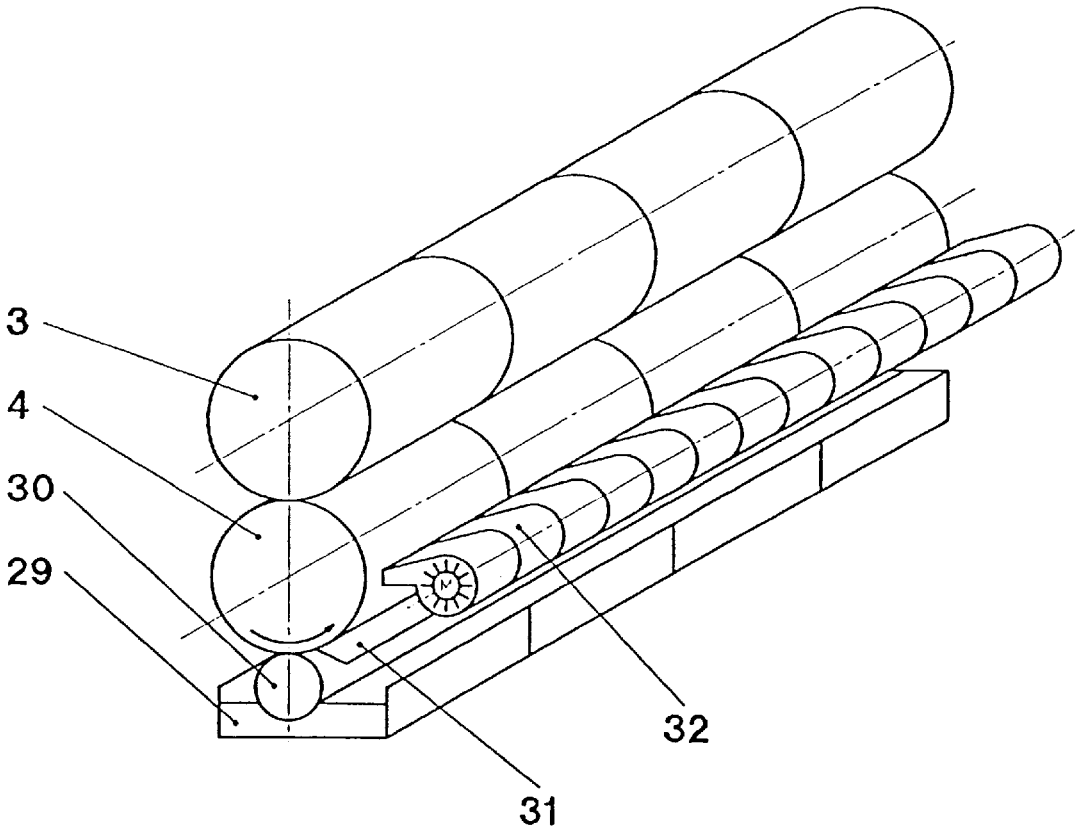
FIG. 3 is a partial perspective view of a second modified embodiment of the anilox printing unit of FIG. 1.

FIG. 3 shows part of an anilox inking unit with the anilox roll 4 and the applicator roll 3. The ink is fed to the anilox roll 4 via a feed roll 30 which dips into an ink fountain 29. A working doctor blade 31 is arranged against the anilox roll, downstream of the feed roll 30 in the direction of rotation of the anilox roll. This working doctor blade is followed, in the direction of rotation of the anilox roll 4, by fans 32, which are lined up in a row in the longitudinal direction of anilox roll 4.

By means of the feed roll 30, the anilox roll 4 is inked with ink from the ink fountain 29 and subsequently doctored off by the working doctor 31. After this, the surface of the anilox roll 4, including the ink surface, is dried by means of the air stream applied by the fans 32. The fans 32 are each driven by their own motor and, depending on the requirement for drying in the zone of the anilox roll 4 on which they act, can simply be switched on or off by switching their respective motor on or off or can be controlled easily with regard to the quantity of air supplied by controlling the speed of the motors. Control is carried out, for example, in the manner shown in FIG. 2, it also being possible for sensors to be provided in numbers greater than the number of pages. Otherwise, the mode of action of the anilox inking unit corresponds to that of the anilox inking units already described.

Figure 4:
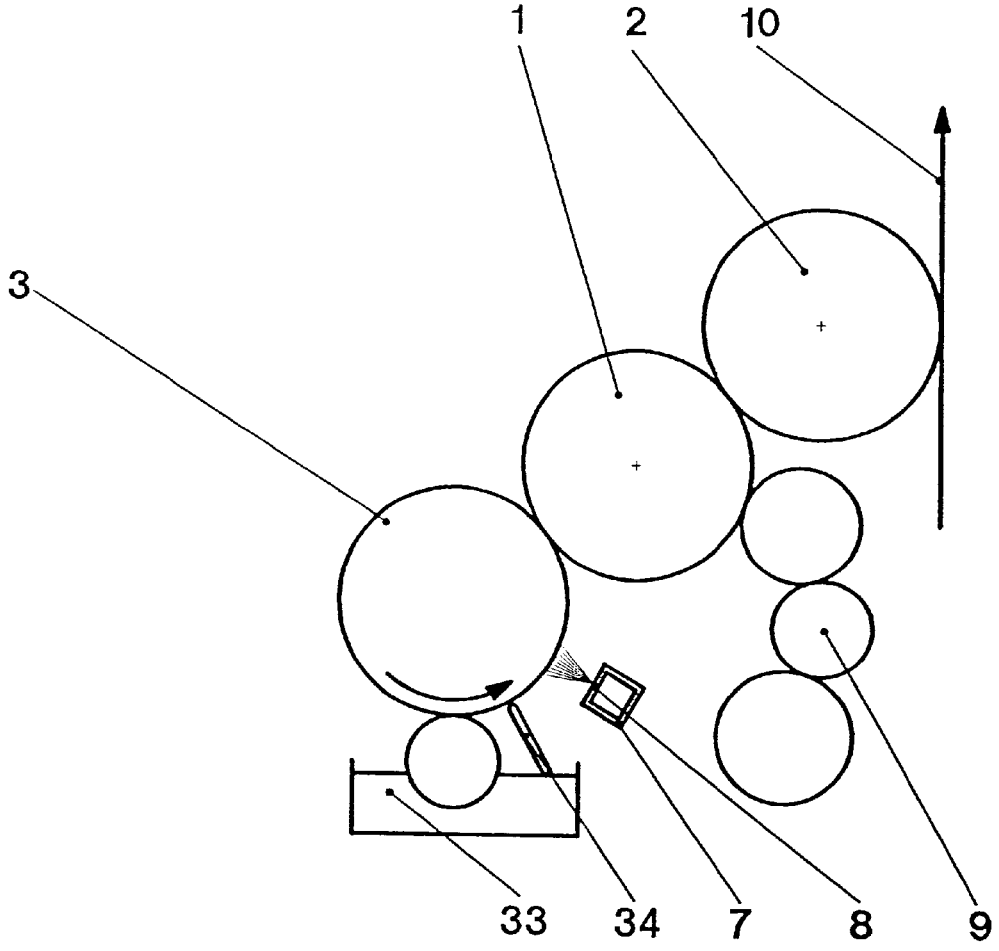
FIG. 4 is a side view of a further embodiment of an inking unit with no zone screws according to the invention.

The invention can also be used in inking units with no zone screws (short inking units) and no anilox roll. FIG. 4 shows such an inking unit, in which, in detail, an applicator roll 3 is arranged against a plate cylinder 1, which in turn is in contact with a transfer cylinder 2. Arranged on the applicator roll 3, one after another in its direction of rotation, are a delivery device 33 for ink, an ink metering device 34 and a blowing device in the form of a nozzle bar 7 with the nozzles 8. A damping unit 9 is placed in contact with the plate cylinder 1.

The applicator roll 3 is fed ink by means of the delivery device 33, and the ink is doctored off to a desired layer thickness as it subsequently passes the ink metering device 34. Surface water which separates during this process is evaporated under the action of the fluid, for example dried room air, flowing out of the nozzles 8 of the nozzle bar 7 during the continued rotation of the applicator roll 3. This provides the preconditions for proper ink splitting and thus for good ink transfer to the printing plate of the plate cylinder 1. The fluid feed may be regulated or controlled in the ways claimed or described with regard to anilox inking units, for which reason repetitive descriptions are omitted. The inked plate cylinder 1 transfers the printing image to the transfer cylinder 2, which prints the web 10.

The invention is not limited by the embodiments described above which are presented as examples only but can be modified in various ways within the scope of protection defined by the appended patent claims.

We claim:

1. An anilox inking unit for an offset printing machine comprising:

an anilox roll being fed ink via a delivery device, and having a rotation direction;

a working doctor disposed against said anilox roll;

a blowing device arranged along said anilox roll downstream of said working doctor in said rotation direction and upstream of an ink transfer point, said blowing device being directed towards said anilox roll;

at least one applicator roll in operable contact with said anilox roll at said ink transfer point;

a plate cylinder in operable contact with said at least one applicator roll; and a damping unit in operable contact with said plate cylinder.

2. The anilox inking unit in accordance with claim 1, wherein said blowing device comprises a nozzle bar having nozzles arranged alongside one another in a longitudinal direction of said anilox roll.

3. The anilox inking unit in accordance with claim 1, wherein said blowing device comprises slot nozzles aligned in a row in a longitudinal direction of said anilox roll.

4. The anilox inking unit in accordance with claim 1, wherein said blowing device comprises fans aligned in a row in a longitudinal direction of said anilox roll.

5. The anilox inking unit in accordance with claim 1, wherein said blowing device comprises adjustment means for adjusting and controlling a quantity of throughput being blown out.

6. The anilox inking unit in accordance with claim 5, wherein said blowing device is controllable in sections.

7. The anilox inking unit in accordance with claim 5, further comprising a blower feeding said blowing device, said blower being speed adjustable/controllable to change a throughput of said blowing device.

8. The anilox inking unit in accordance with claim 1, further comprising a chamber-type doctor for feeding ink to said anilox roll, said working doctor being part of said chamber-type doctor.

9. The anilox inking unit in accordance with claim 1, further comprising:

a feed roll in operable contact with said anilox roll; and an ink fountain in operable contact with said feed roll such that said feed roll dips into said ink fountain during operation of the anilox inking unit.

10. An inking unit having no zone screws in combination with a rotary offset printing machine comprising:

an applicator roll having a rotation direction;

a plate cylinder in operable contact with said applicator roll;

a ink delivery device in operable contact with said applicator roll and having an ink metering unit arranged against said applicator roll;

a damping unit in operable contact with said plate cylinder; and a blowing device arranged along said applicator roll and being directed toward said applicator roll for blowing a fluid, said blowing device being disposed downstream of said ink metering device with respect to said rotation direction and upstream with respect to a point of contact between said applicator roll and said plate cylinder.

11. An anilox inking unit for an offset printing machine, comprising:

an anilox roll being fed ink via a delivery device, and having a rotation direction;

a working doctor disposed against said anilox roll;

a blowing device arranged along said anilox roll downstream of said working doctor in said rotation direction and upstream of an ink transfer point, said blowing device being directed toward said anilox roll, said blowing device comprising adjustment means for adjusting or controlling a quantity of throughput being blown out;

at least one applicator roll in operable contact with said anilox roll;

a plate cylinder in operable contact with said at least applicator roll;

a damping unit in operable contact with said plate cylinder;

at least one sensor arranged on said plate cylinder for sensing the inking;

a control device connected to said at least one sensor; and at least one throttling member connected to said control device and disposed in an air supply path of said fluid blowing device in a corresponding area of said anilox roll, said at least one throttling member controlling air flow from said blowing device in response to a sensed erroneous inking by said at least one sensor.

* * * * *